US009901802B2

(12) United States Patent
Nowicki

(10) Patent No.: US 9,901,802 B2
(45) Date of Patent: Feb. 27, 2018

(54) AUDIO AND VISUAL/TOUCH GOLF TRAINING DEVICE AND TRAINING METHOD USING GOLF TRAINING DEVICE

(71) Applicant: MN Sport Products, LLC, Syracuse, NY (US)

(72) Inventor: Martin Nowicki, Syracuse, NY (US)

(73) Assignee: MN Sport Products, LLC, Syracuse, NY (US)

( * ) Notice: Subject to any disclaimer, the term of this patent is extended or adjusted under 35 U.S.C. 154(b) by 0 days.

(21) Appl. No.: 15/405,894

(22) Filed: Jan. 13, 2017

(65) Prior Publication Data

US 2017/0203180 A1 Jul. 20, 2017

Related U.S. Application Data

(60) Provisional application No. 62/278,765, filed on Jan. 14, 2016.

(51) Int. Cl.

| | |
|---|---|
| ***A63B 69/36*** | (2006.01) |
| ***A63B 71/06*** | (2006.01) |
| ***A63B 15/00*** | (2006.01) |
| ***A63B 59/20*** | (2015.01) |

(52) U.S. Cl.

CPC ..... *A63B 69/36* (2013.01); *A63B 15/005* (2013.01); *A63B 59/20* (2015.10); *A63B 69/3632* (2013.01); *A63B 69/3635* (2013.01); *A63B 71/0622* (2013.01); *A63B 2071/0625* (2013.01); *A63B 2071/0627* (2013.01); *A63B 2071/0655* (2013.01); *A63B 2208/0204* (2013.01)

(58) Field of Classification Search

USPC ..... 473/223, 224, 234, 422, 437, 451, 457

See application file for complete search history.

(56) References Cited

U.S. PATENT DOCUMENTS

| | | | | |
|---|---|---|---|---|
| 3,498,616 A * | 3/1970 | Hurst | ..... | A63B 69/3635 473/234 |
| 4,614,343 A | 9/1986 | Radway | | |
| 5,524,892 A * | 6/1996 | Karp | ..... | A63B 69/3632 473/201 |

(Continued)

OTHER PUBLICATIONS

ISA/US International Search Report and Written Opinion for Corresponding International Application No. PCT/US17/13409, dated Apr. 20, 2017 (8 pgs).

(Continued)

*Primary Examiner* — Nini Legesse
(74) *Attorney, Agent, or Firm* — Harris Beach PLLC

(57) ABSTRACT

A golf training device with audio and visual/touch cues for independent golf swing training in an absence of a golf instructor includes a tube having a first end and a second end and an outer surface. A sliding mass is disposed slidingly within the tube, the sliding mass including a chamfer on at least one end of the sliding mass. An end stop is mechanically affixed to the first end of the tube. A ball holding rod has a ball hold rod first end and a ball hold rod second end. A bushing is disposed on the ball hold rod first end to mechanically couple the ball hold rod first end to the second end of the tube, an outer diameter of the bushing including a male thread corresponding to a female thread disposed in the second end of the tube. A ball is coupled to the ball holding rod.

10 Claims, 19 Drawing Sheets

(56) References Cited

U.S. PATENT DOCUMENTS

| | | | | |
|---|---|---|---|---|
| 5,590,875 | A * | 1/1997 | Young | A63B 43/00 473/451 |
| 6,645,083 | B1 | 11/2003 | Armstrong, III et al. | |
| 6,719,639 | B2 | 4/2004 | Novosel, Sr. | |
| 2003/0083140 | A1 | 5/2003 | Bamber | |
| 2008/0176667 | A1 | 7/2008 | Gutierrez | |
| 2015/0224384 | A1 | 8/2015 | Timm et al. | |

OTHER PUBLICATIONS

"Impactsnap training video" (Martin Nowicki) Nov. 3, 2015 (Nov. 3, 2015) [video] accessed Mar. 8, 2017 at <https://youtube/GBiNQ40Wizo>, entire video.

"Impact Snap! Instructional Video" (Kelvin Miyahira) May 2, 2010 (May 2, 2010) [video] accessed Mar. 8, 2017 at <https://youtube/oOil_baXtq4>.

* cited by examiner

AUDIO AND VISUAL/TOUCH GOLF TRAINING DEVICE AND TRAINING METHOD USING GOLF TRAINING DEVICE

CROSS-REFERENCE TO RELATED APPLICATIONS

This application claims priority to and the benefit of U.S. provisional patent application Ser. No. 62/278,765, AUDIO AND VISUAL/TOUCH GOLF TRAINING DEVICE AND TRAINING METHOD USING GOLF TRAINING DEVICE, filed Jan. 14, 2016, which application is incorporated herein by reference in its entirety.

FIELD OF THE APPLICATION

The application relates to a golf swing training device and particularly to a golf swing training device with audio and visual/touch cues.

BACKGROUND

Golf students are typically trained based on observed training swings, or video analysis of their training swings. A back and forth discussion between the student and the golf professional or golf instructor follows where the student is provided with feedback. Such training is time consuming and labor intensive for the instructor as well as costly and time consuming for the student.

SUMMARY

According to one aspect, a golf training device with audio and visual/touch cues for independent golf swing training in an absence of a golf instructor includes a tube having a first end and a second end and an outer surface. A hand grip is disposed at least in part about the outer surface of the tube. A sliding mass is disposed slidingly within the tube, the sliding mass including a chamfer on at least one end of the sliding mass. An end stop is mechanically affixed to the first end of the tube. A ball holding rod has a ball hold rod first end and a ball hold rod second end. A bushing is disposed on the ball hold rod first end to mechanically couple the ball hold rod first end to the second end of the tube, an outer diameter of the bushing including a male thread corresponding to a female thread disposed in the second end of the tube. A ball is mechanically coupled to the second end of the ball holding rod. The ball holding rod includes a first ball holding rod bend of about 80 degrees near where the ball holding rod couples to the tube and a second ball holding rod bend of about 70 degrees near the ball, and there is about an 80 to 90 degree angle between two planes defined by each of the first ball holding rod bend and the second ball holding rod bend.

In one embodiment, the tube includes aluminum.

In another embodiment, the ball holding rod includes aluminum.

In yet another embodiment, the end stop includes one half of a threaded pipe coupler.

In yet another embodiment, the bushing includes a modified pipe thread.

In yet another embodiment, the sliding mass includes a cold rolled steel rod.

In yet another embodiment, the sliding mass includes a mass between about 100 and 300 grams.

In yet another embodiment, the ball includes a golf ball.

In yet another embodiment, the golf training device further including a cap disposed over the end stop and a portion of the first end of the tube.

In yet another embodiment, the cap includes an air hole.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

As described hereinabove, golf students are typically trained based on observed training swings, or video analysis of their training swings. A back and forth discussion between the student and the golf professional or golf instructor follows where the student is provided with feedback. Such training is time consuming and labor intensive for the instructor as well as costly and time consuming for the student.

What is needed is an improved golf training device that can be used by a student in the absence of an instructor, which teaches a golf student how to use the wrist properly during a golf swing. An improved golf training device is described in detail hereinbelow. Part I describes the component parts and structure of the golf training device. Part II describes methods of manufacture of the golf training device. Part III describes an embodiment of the golf training device with exemplary dimensions. Part IV describes a method of golf swing training using the golf training device.

Part I: Structure—Audio and Visual/Touch Golf Training Device

COMPONENT PARTS

Hand Grip 101
Mounted ball 103
Ball holding rod 105 (also referred to as a stem)
Tube 107 having threads 603
Cap 109
End stop 201
Bushing 301
Sliding mass 601

Figure 1:
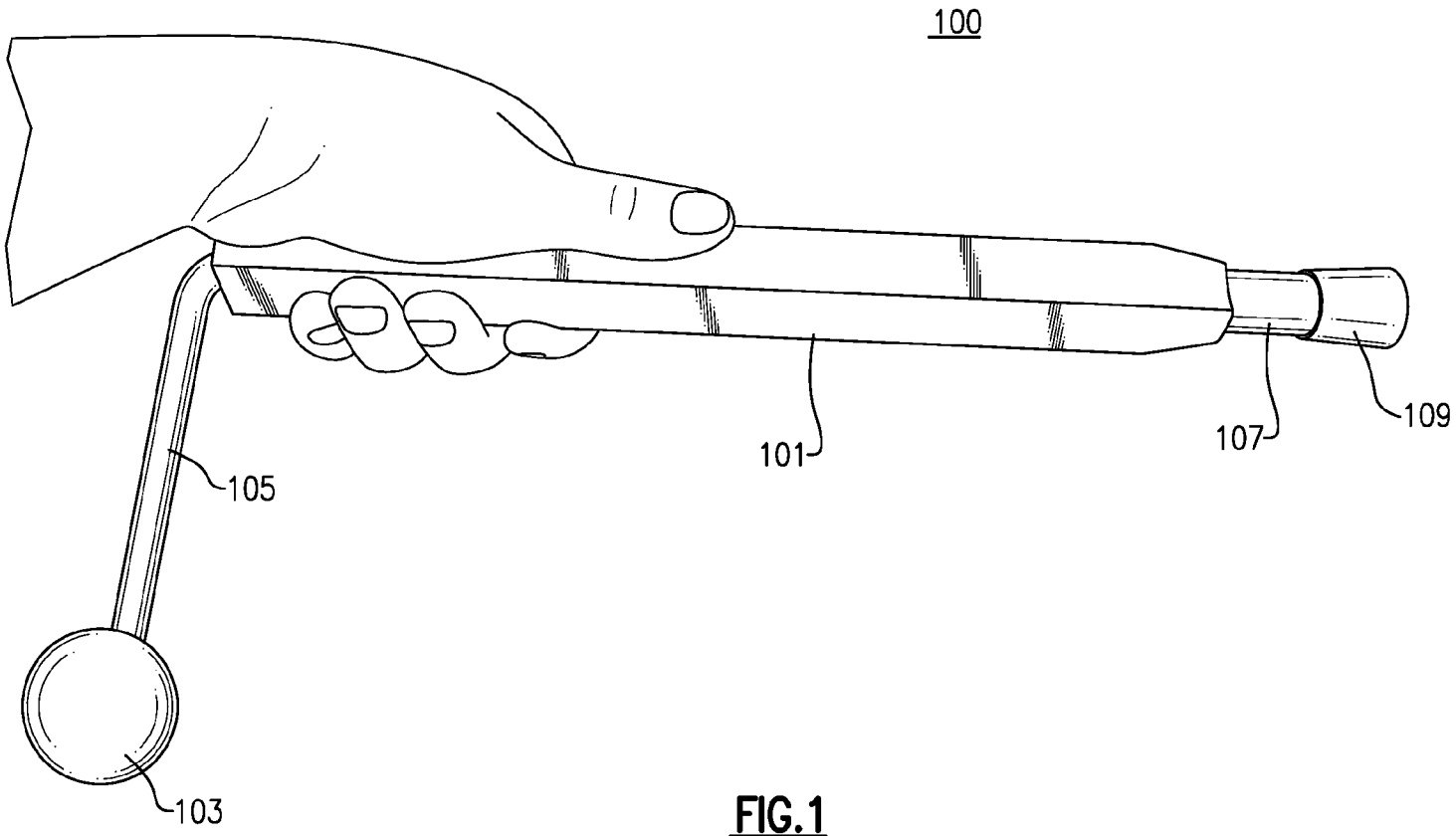
FIG. 1 shows a side view of a manual golf training device.

Now, turning to FIG. 1, FIG. 1 shows a side view of a manual golf training device 100, also referred to as IMPACT SNAP. The device includes a golf ball sized ball, which can be a golf ball, affixed to a ball holding rod 105, also called a stem. As will be described in more detail hereinbelow, the ball holding rod 105 has two bends at either end of the ball holding rod 105 in different directions. Ball holding rod 105 is fixed attached to a tube 107. A manual gripping handle, hand grip 101 covers most of tube 107. On the end of tube 107 opposite the fixed mechanical connection to the ball holding rod 105, there is a cap 109.

Figure 2:
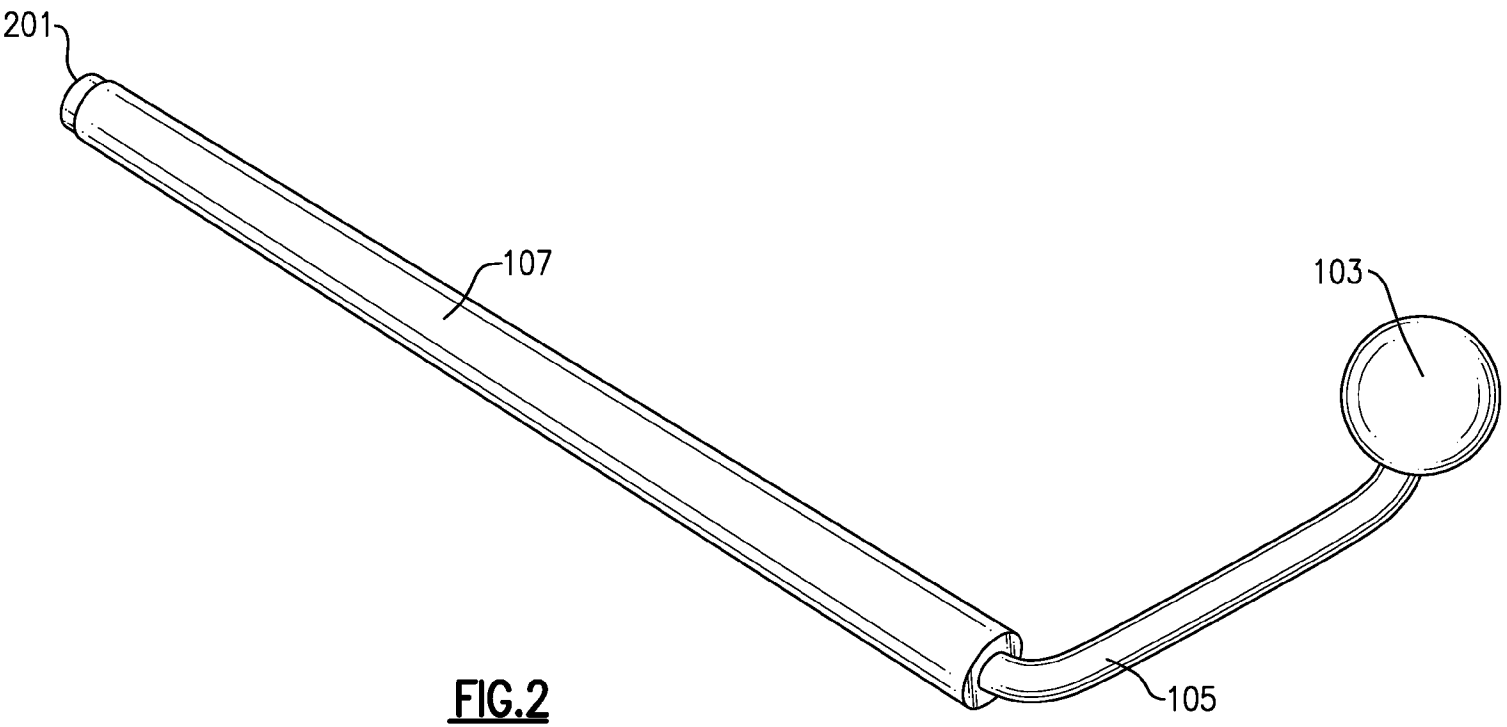
FIG. 2 shows an isometric view of the golf training device of FIG. 1.

FIG. 2 shows an isometric view of the golf training device 100 of FIG. 1 where hand grip 101, and cap 109 have not yet been installed. End stop 201 can be seen as not yet covered by cap 109.

Figure 3:
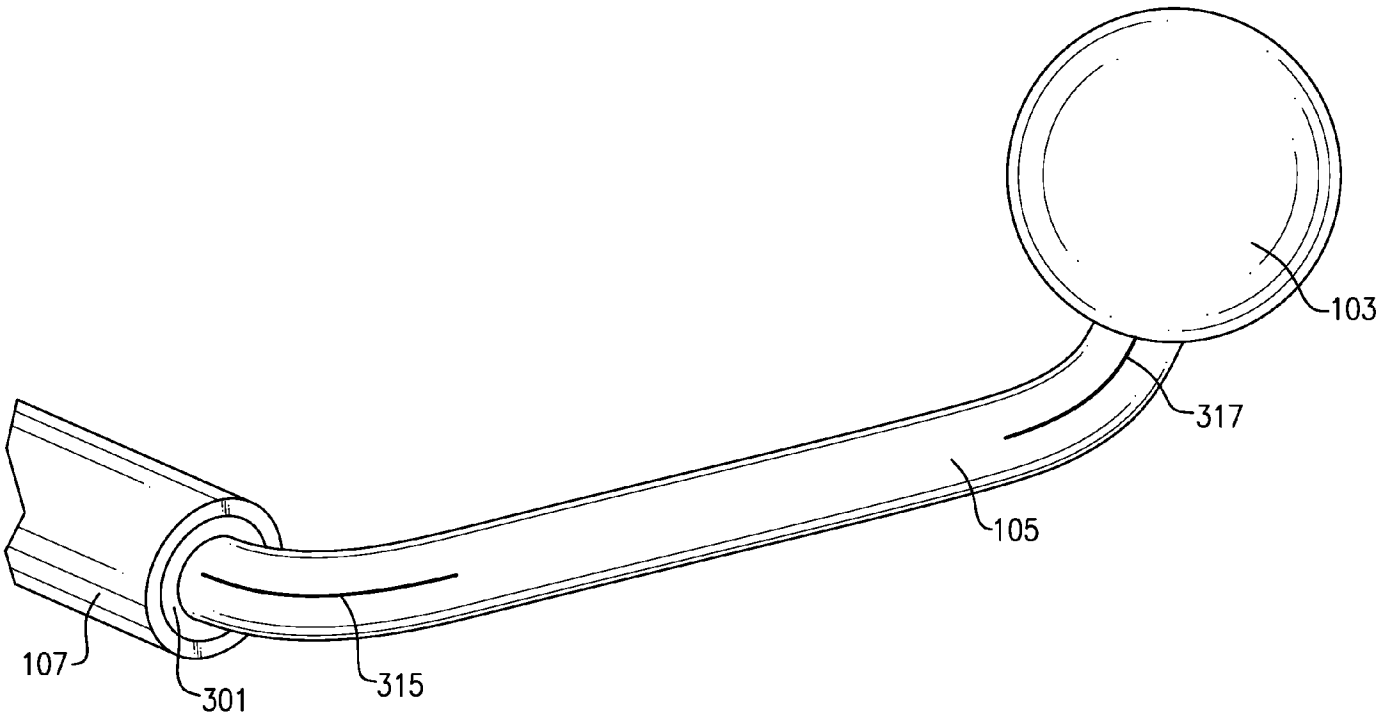
FIG. 3 shows a more detailed view of the golf training device of FIG. 2.

FIG. 3 shows a more detailed view of the golf training device 100 of FIG. 2. Bushing 301 couples the ball holding rod 105 to the end portion of tube 107. There is about an 80 degree angle bend 315 of ball holding rod 105 near bushing 301 and about a 70 degree bend 317 at the other end of ball holding rod 105 where ball holding rod 105 couples into ball 103. There is also about an 80 to 90 degree angle between the planes defined by each of the two bends. There is also about a 30 degree bend downward that during use, as explained in more detail hereinbelow, puts the ball under the trailing forearm to encourage proper wrist movement.

Figure 4:
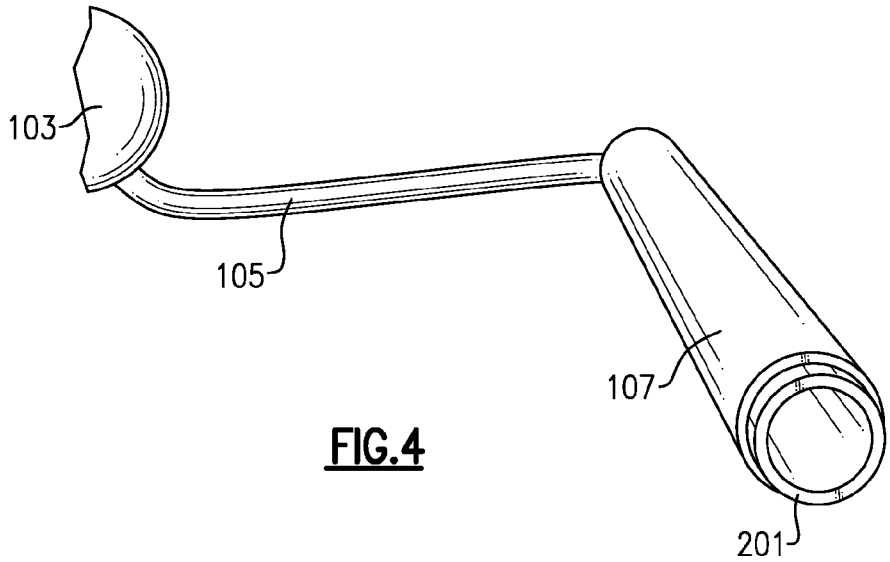
FIG. 4 shows a more detailed end view of the golf training device of FIG. 2.
Figure 5:
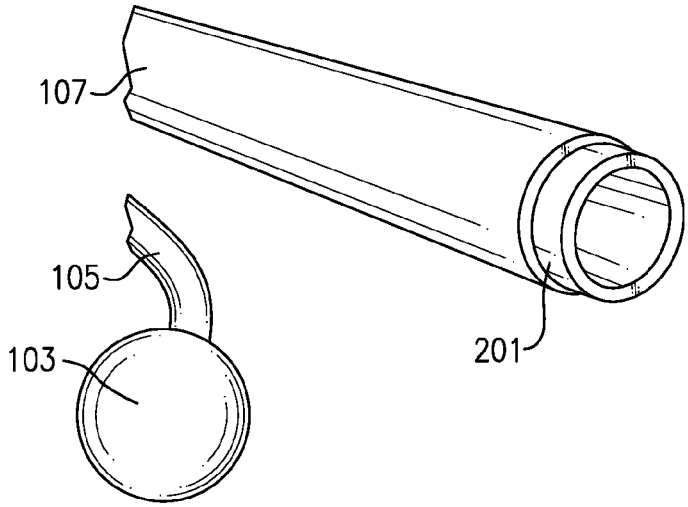
FIG. 5 shows another end view of the golf training device of FIG. 2.

FIG. 4 shows a more detailed end view of the golf training device 100 of FIG. 2. End stop 201 can be seen more clearly as mechanically affixed in part within an end portion of tube 107. FIG. 5 shows another end view of the golf training device 100 of FIG. 2.

Figure 6:
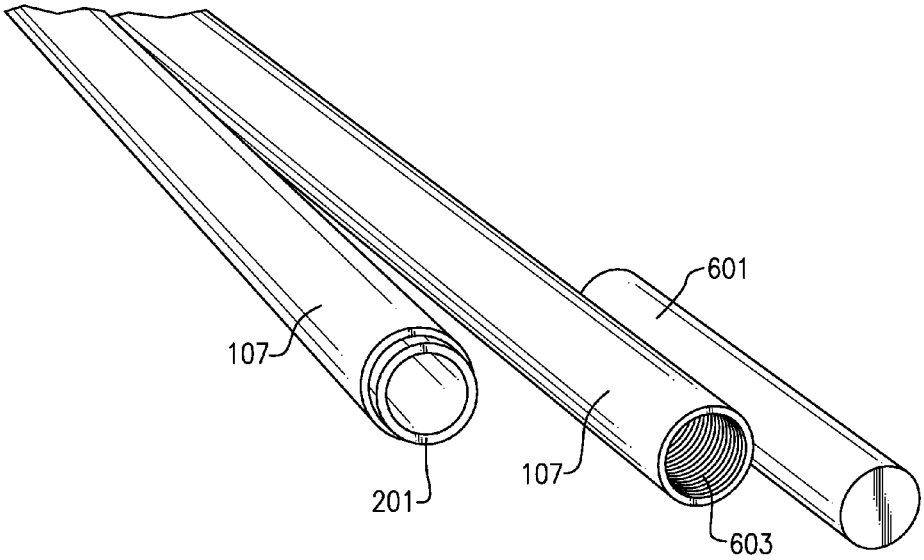
FIG. 6 shows two exemplary tubes in various stages of assembly and a sliding mass.

FIG. 6 shows two tubes 107. The first tube has an end stop 201 installed. The second tube shows an exemplary embodiment where a tube 107 has a female thread to accept a male threaded end stop 201. Also, visible in FIG. 6 is one exemplary embodiment of a sliding mass 601.

Figure 7A:
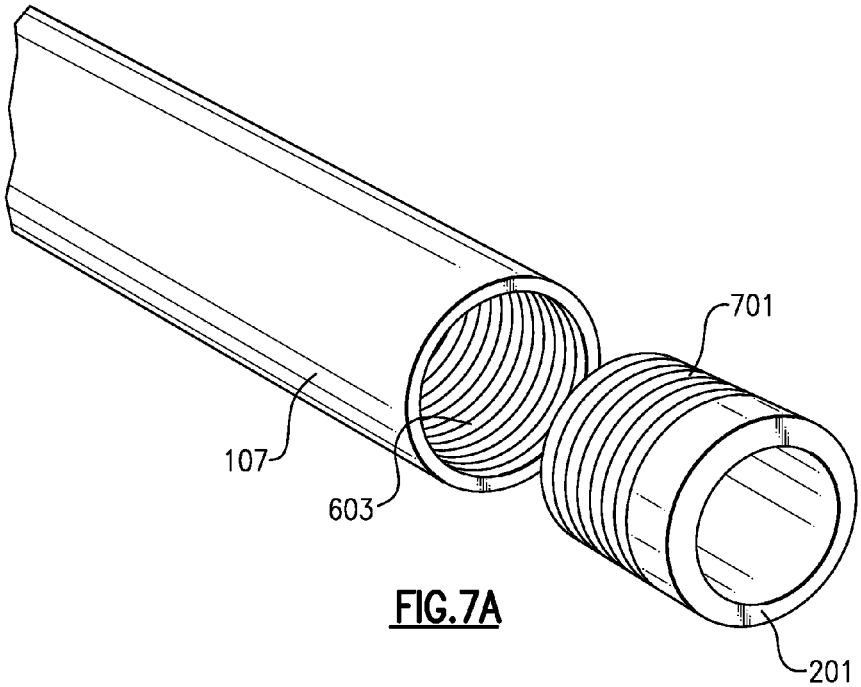
FIG. 7A shows a more detailed view of the tube and end stop of the golf training device of FIG. 2 prior to assembly.
Figure 7B:
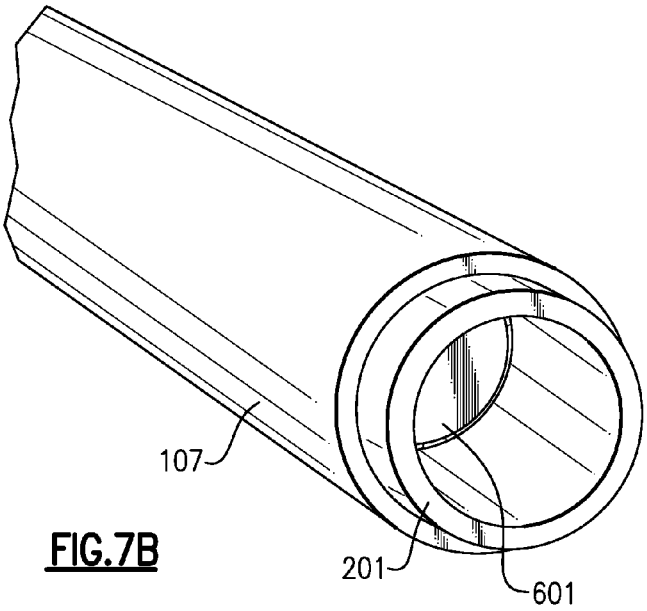
FIG. 7B shows another end view of the tube and end stop of the golf training device of FIG. 2 after assembly.

FIG. 7A shows a more detailed view of the tube and end stop of the golf training device of FIG. 2 prior to assembly. FIG. 7B shows another end view of the tube and end stop of the golf training device of FIG. 2 after assembly where a sliding mass 601 can be seen resting against end stop 201.

Figure 8:
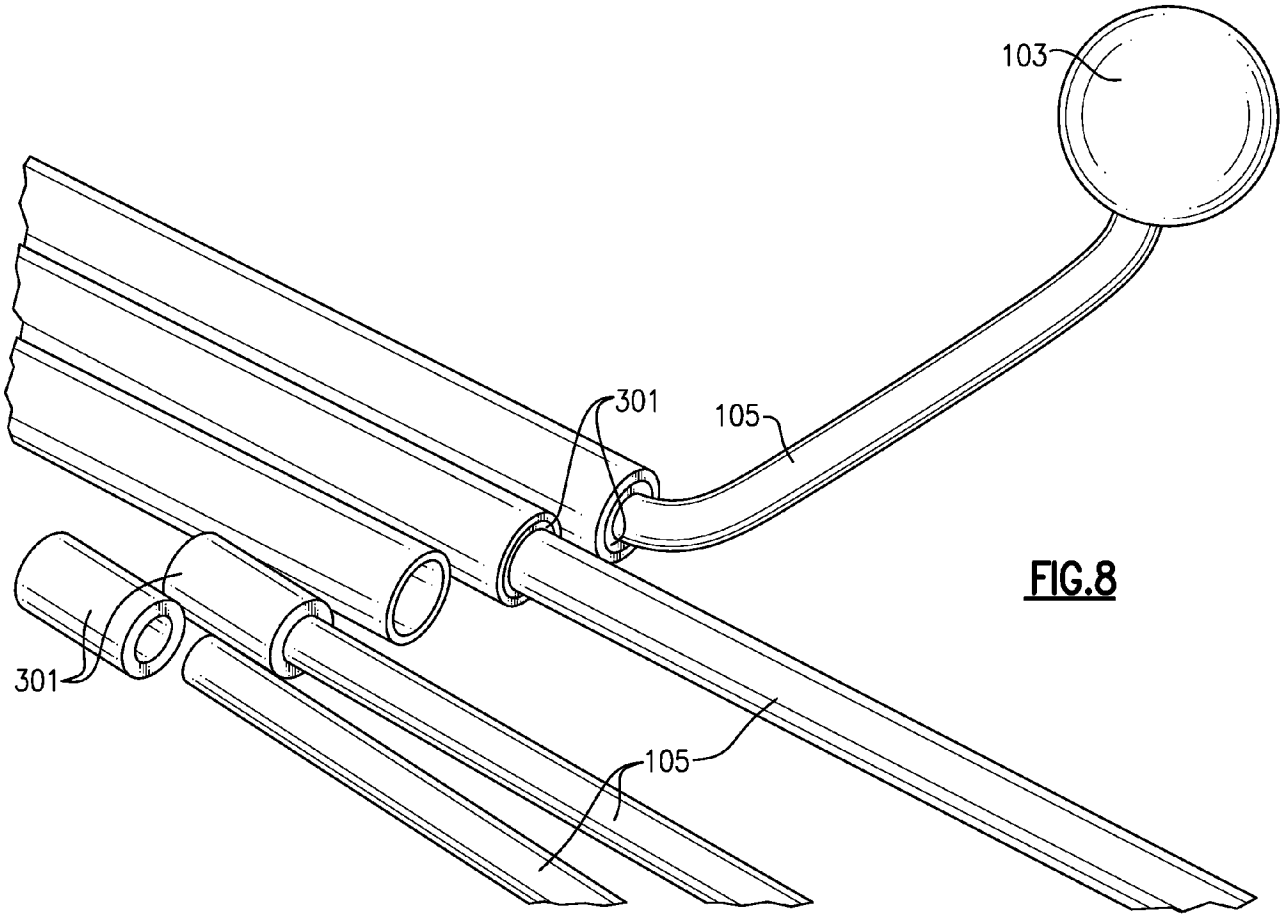
FIG. 8 shows the ball end of three tubes in various stages of assembly.

FIG. 8 shows the ball 103 end of three tubes 107 in various stages of assembly. Also shown, are four ball holding rods 105 and two bushings 301 in various stages of bending and assembly.

Figure 9:
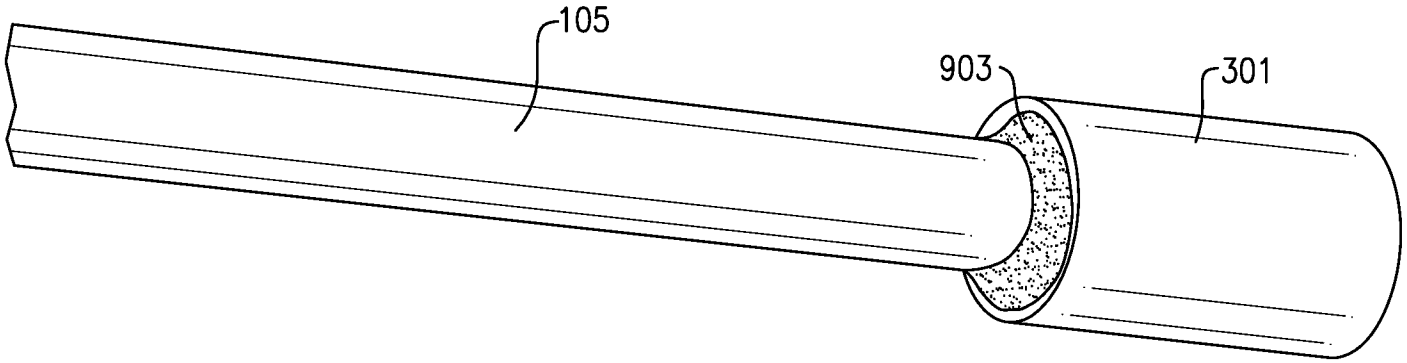
FIG. 9 shows an exemplary bushing mechanically affixed to a ball holding rod by a glue or epoxy.

FIG. 9 shows an exemplary bushing 301 mechanically affixed to a ball holding rods 105 using a glue or epoxy 903.

Figure 10A:
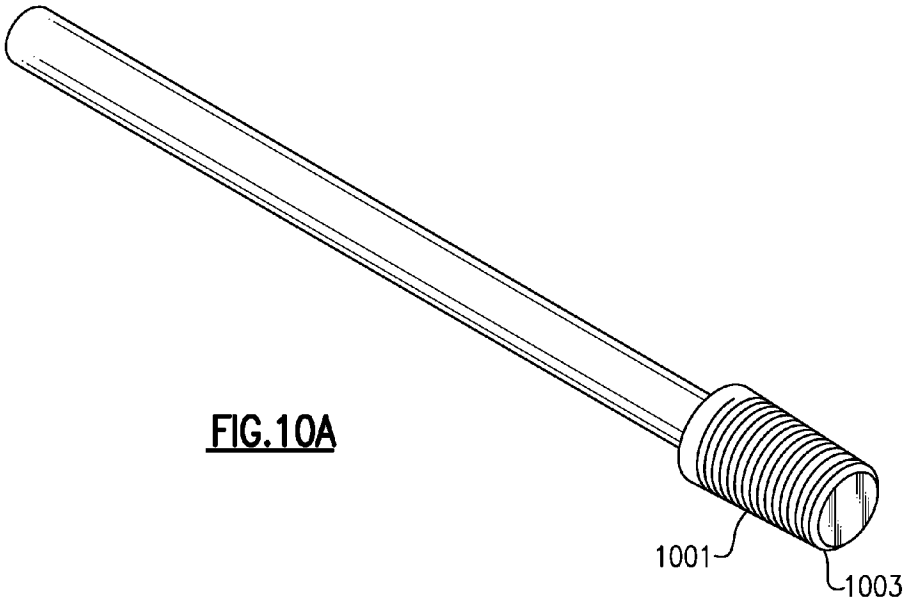
FIG. 10A shows an improved stem structure for mechanically coupling a ball holding rod to a tube.

FIG. 10A shows an improved stem structure 1000 for mechanically coupling a ball holding rod 105 to a tube 107. The exemplary bushing 301 of the earlier drawings is replaced by a bushing having a modified pipe thread 1001. Moreover, a taper 1003 facilitates a quick and efficient assembly into a corresponding female thread in a tube 107. While a glue, epoxy, or thread fixing compound can still be used, in many cases the threaded connection alone is sufficiently strong and stable.

Figure 10B:
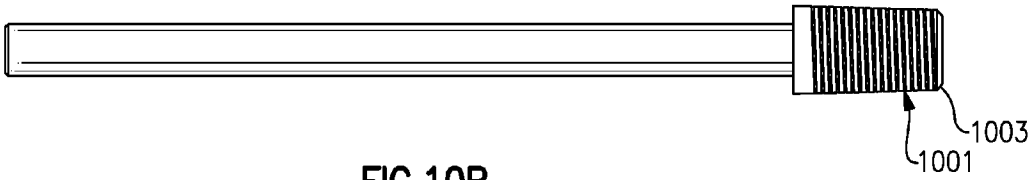
FIG. 10B shows a side view drawing of the improved stem structure of FIG. 10A.
Figure 10C:
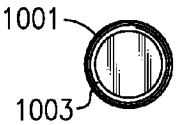
FIG. 10C shows an end view drawing of the improved stem structure of FIG. 10A.

FIG. 10B shows a side view drawing of the improved stem structure 1000 of FIG. 10A. FIG. 10C shows an end view drawing of the improved stem structure 1000 of FIG. 10A.

Figure 11A:
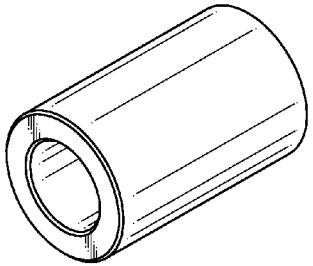
FIG. 11A shows an isometric view of an exemplary embodiment of another embodiment of the bushing.
Figure 11B:
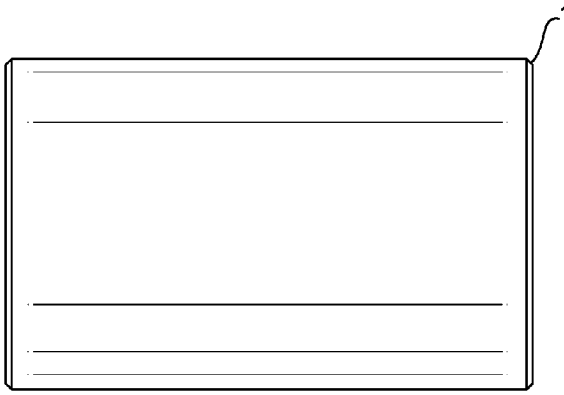
FIG. 11B shows a side view drawing of the bushing of FIG. 11A.
Figure 11C:
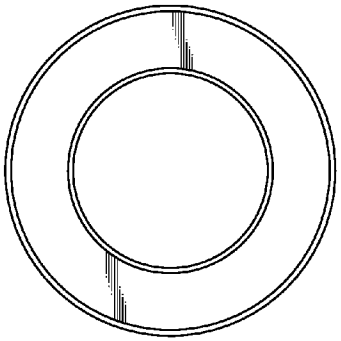
FIG. 11C shows an end view drawing of the bushing of FIG. 11A.

FIG. 11A shows an isometric view of an exemplary embodiment of the earlier bushing 301. FIG. 11B shows a side view drawing of the bushing 301 of FIG. 11A. FIG. 11C shows an end view drawing of the bushing 301 of FIG. 11A.

Figure 12A:
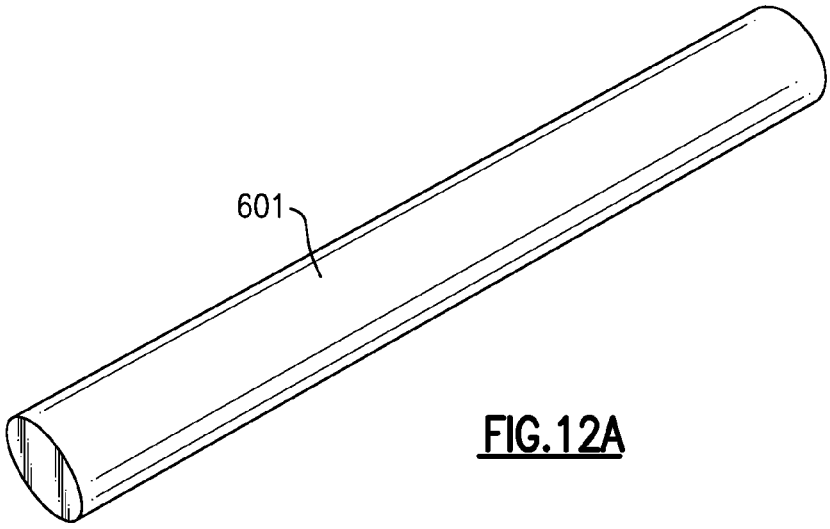
FIG. 12A shows a view of an exemplary sliding mass.
Figure 12B:
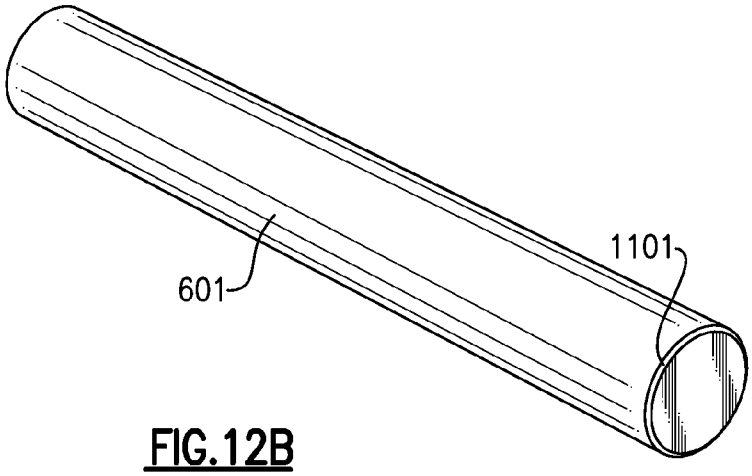
FIG. 12B shows a view of an improved exemplary sliding mass.

FIG. 12A shows a view of an exemplary sliding mass 601 which was ground to a dual tapered shape to achieve a first sliding characteristic through tube 107. FIG. 12B shows a view of an improved exemplary sliding mass 601 which includes a slight chamfer 1101. It was realized that an improved sliding performance could be achieved as well as providing more cost effective and efficient manufacturing by replacing the original ground sliding mass with a smaller diameter sliding mass 601, in some embodiments, with relatively slight chamfer at either end as opposed to the relatively long and complex dual ground taper from about the center towards both ends of a sliding mass 601, as shown in FIG. 12A.

A golf training device 100 can be manufactured as either a left or right handed device. The left and right handed units are substantially mirror images of each other.

Part II—Method of Manufacture—Audio and Visual/Touch Golf Training Device

Exemplary Method:

Cut tube 107 to length using any suitable cutting method. Typically, tube 107 is an aluminum tube and any suitable means to cut an aluminum tube can be used.

De-burr both ends of tube 107 using any suitable means, such as a sander.

In some embodiments of the golf training device, ball holding rod 105 was glued into a bushing 301 which was then glued into one end of tube 107.

According to the improvement, tap both ends of tube 107 using a NPT pipe tap by any suitable means, such as, for example, an impact drill with tap epoxied into the impact socket. Use any suitable tapping fluid, such as, for example, WD-40. Wash with any suitable degreaser, such as, for example, Simple Green™. One exemplary tool includes a ⅜" cleaning rod with Scotch Brite™ epoxied onto it.

Manufacture the ball holding rod, for example, as per FIG. 10A. Cut a suitable length of rod, such as, for example an aluminum rod by any suitable means, such as, for example, a metal chop saw. De-burr both ends of the cut ball holding rod. Finish the ball holding rod as desired, such as, for example, by use of a Norton Bear-Tex wheel.

Epoxy a bushing onto one side of the ball holding rod. In the improvement, cut modified NPT male threads into the outer surface of the bushing by any suitable threading means as per FIG. 10B. The modified NPT male threads into the outer surface of the bushing can then be threaded into a threaded end of tube 107.

Sand and polish the tube and/or ball holding rod to a desired level of finish.

Install the hand grip 101 over the tube 107 using any suitable fastening or adhesive means, such as, for example, by use of a two sided tape.

Bend 315 and bend 317 into ball holding rod 105. Check both bends for angle tolerance of about +/−3 degrees, ball 103 height above a surface tolerance of about +/−0.5 inches, and finish as desired.

Ball 103 can be a standard golf ball. While color is unimportant, it has been found that a bright color, such as, for example, road work yellow provides good visibility for training use. The hole can be drilled by any suitable drilling method. For example, the hole can be manually drilled using a drill press, for example, using a ⅜ inch drill bit to be sunk about 1.1 inches into a ball having a ball diameter of about 1.68 inches.

In some embodiments of the golf training device, sliding mass 601 was made from an oversized steel rod. Sliding mass 601 can typically have a mass from about 100 grams to 300 grams. In manufacturing, a slight but lengthy taper was made from about the center towards both ends, such as by grinding both ends to create the relatively complex taper. See FIG. 12A. Because of the friction of the ground outside surface of the sliding mass and the inside surface of the tube 107, a mass of over about 175 grams was used.

According to another improvement, deburr the ends of a sliding mass 601, such as, for example a desired length metal rod of solid cold rolled steel round rod to achieve a sliding mass profile similar to that shown in FIG. 11B and FIG. 12B which includes a slight chamfer 1101. Because of the relatively smooth outside surface of the cold rolled steel round rod sliding mass and the friction characteristics of the inside surface of the tube 107, a smaller mass of about 150 grams was found to be sufficient.

Make end stop 201 from a coupler, such as, for example, a NPT coupler. An NPT coupler has a relatively short straight section between two NPT male threaded ends. Cut the stock coupler in half, de-burr and chamfer.

After inserting the sliding mass, thread the previously prepared end stop 201 into corresponding threads of one side of tube 107.

Fit a cap 109 over the end of the end stop 201 and tube 107. Any suitable cap can be used, such as for example a chair end cap available from Robert Brooke and Associates of Troy, Mich. Drill or punch an air hole into the cap to provide a flow of air as sliding mass 601 slides in tube 107.

Finish clean assembled golf training device, such as for example, with alcohol.

Part III: Detailed Example—Audio and Touch Golf Training Device

The following specific exemplary device with exemplary dimensions is intended only as a representation of an exemplary embodiment of the golf training device as described herein.

Tube 107 was made from a ¾ inch outside diameter (OD) aluminum tube about 13 inches long. Ball holding rod 105 was bent from a 7 inch long ⅜ inch OD aluminum rod. Both sides of tube 107 were threaded with a ⅜ inch NPT pipe thread. A portion of an outer surface of aluminum bushing 301 was cut to have a modified male ⅜ inch NPT pipe thread. The ball holding rod 105 was epoxied to the inner surface of the bushing. In some embodiments, the modified thread of bushing 301 (FIG. 10B) can be one solid piece widdled down and threaded to fit the threads of the interior of tube 107. Sliding mass 601 was cut to a 4 inch length from a 0.625 inch diameter cold rolled steel rod. The mass of sliding mass 601 was about 150 grams.

Part IV: Method of Use—Training Method Using Golf Training Device

DEFINITIONS

Release: Release is generally used in the context of a release of the angle between the leading arm and the shaft itself. In anatomical terms, release includes the redial and ulna deviation (cocking and un cocking) of the leading wrist combined with the flexion (bowing) of the lead wrist and an amount of supination (rotation) of leading arm based on what type of grip is employed, so the shaft at some point after impact is in alignment with the leading arm. Release as used herein also includes (e.g. for a right handed swing) right humorous releases from the right shoulder and starts to move the arms in front of the body, lead arm releases from the shoulder, where the lead wrist starts to un cock (radial deviation toward ulna deviation), where the trailing arm starts to straighten as the forearm releases from the humorous, and where the lead forearm rotates.

Figure 13B:
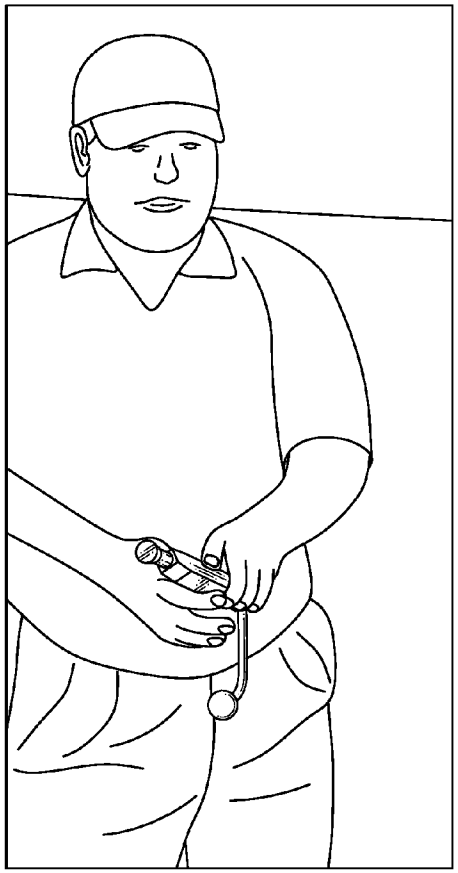
FIG. 13B is a drawing which illustrates a second position of supination.
Figure 13A:
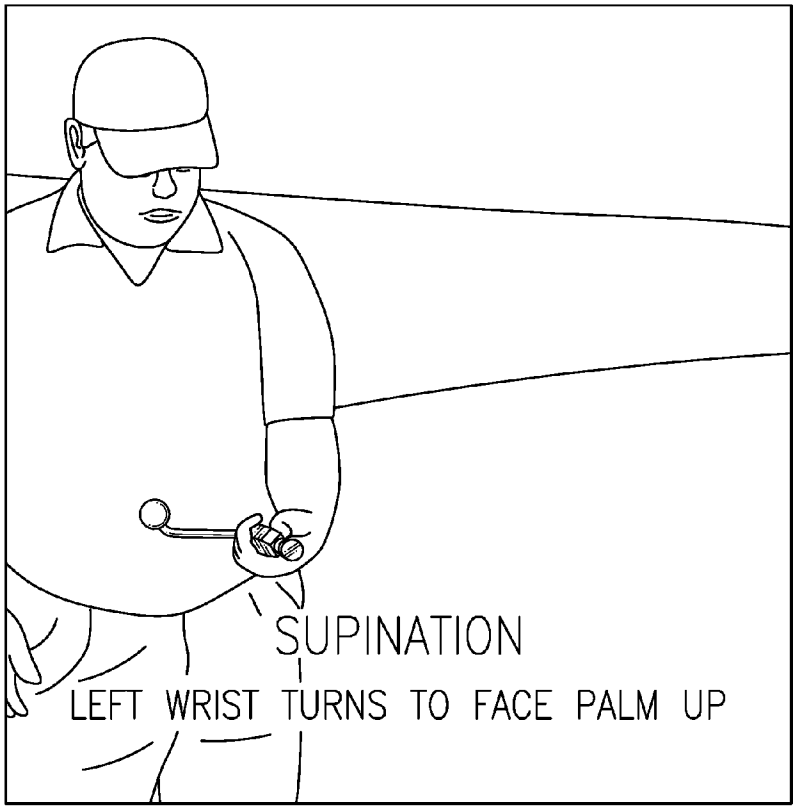
FIG. 13A is a drawing which illustrates a first position of supination where the wrist turns the face of the palm up.
Figure 14B:
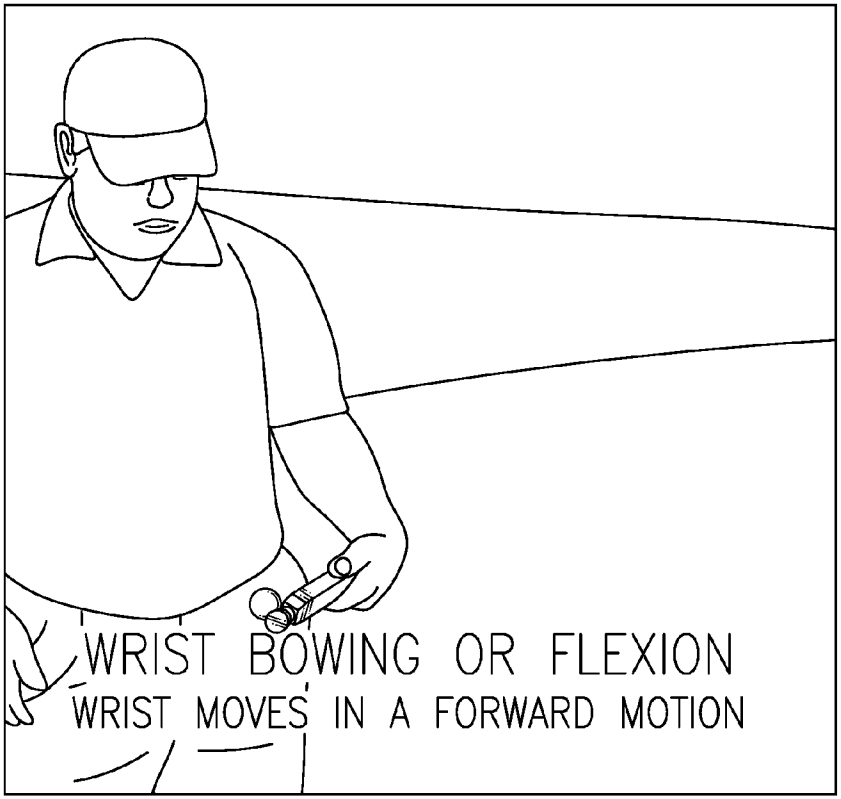
FIG. 14B is a drawing which illustrates a second position of wrist bowing or flexion where the wrist moves in a forward motion.
Figure 14A:
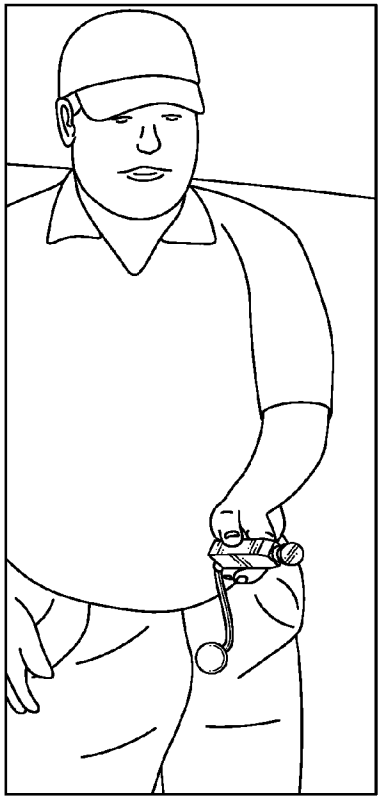
FIG. 14A is a drawing which illustrates a first position of wrist bowing or flexion.
Figure 15A:
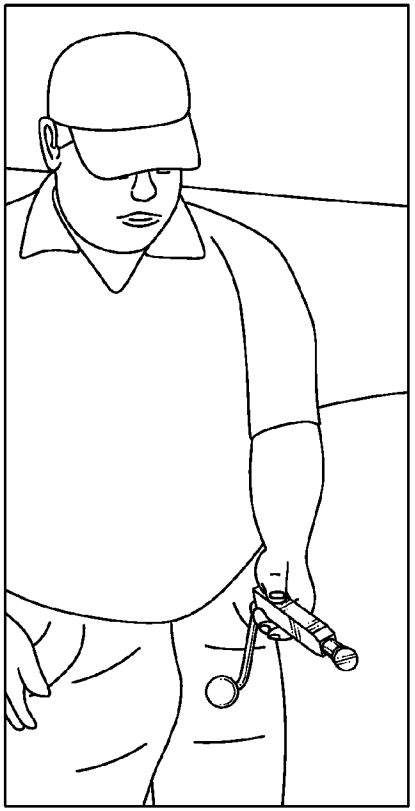
FIG. 15A is a drawing which illustrates a first position of Ulnar deviation.
Figure 15B:
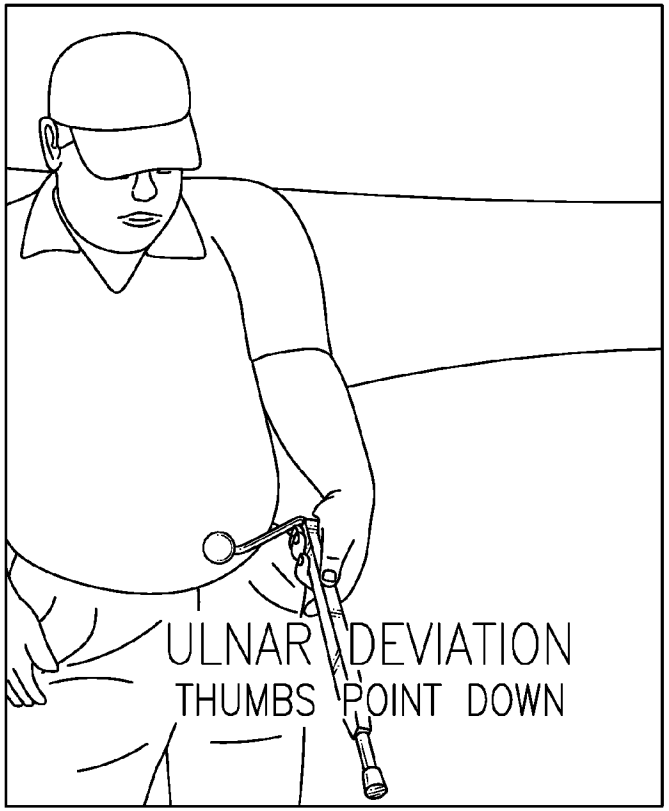
FIG. 15B is a drawing which illustrates a second position of Ulnar deviation where the thumb points down.
Figure 20B:
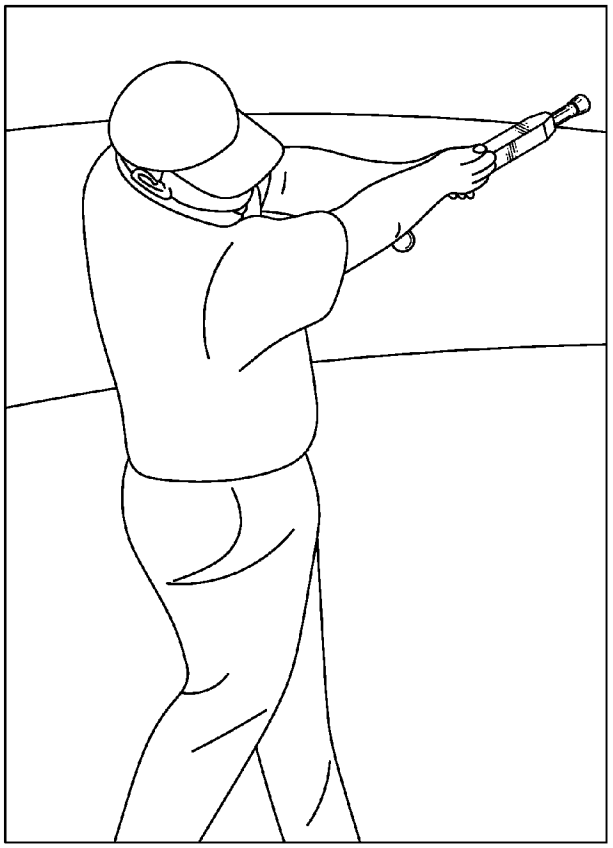
FIG. 20B is a drawing which illustrates an end position of a complete powerful golf swing release pattern.
Figure 20A:
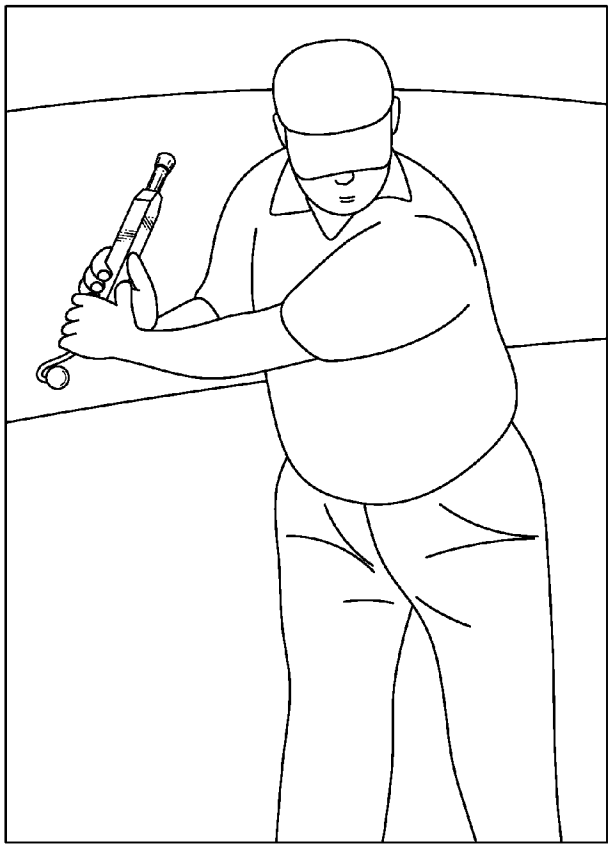
FIG. 20A is a drawing which illustrates a first position of a complete powerful golf swing release pattern.

The golf training devices as described hereinabove, can be used to efficiently teach a golfer how to properly position and use the arm, wrist, and hand during a golf swing. There are three fundamental arm and wrist motions which can be taught using a golf training device 100, 1) Radial or Ulnar Deviation: how to cock and un-cock wrist (FIG. 15A, FIG. 15B) including a motion where the thumb starts to point down; 2) how to flex the leading wrist (FIG. 14A, FIG. 14B); and 3) how to supinate the leading arm (FIG. 13A, FIG. 13B). The goal of training these three fundamental arm and wrist motions is to achieve a powerful consistent release pattern (FIG. 20A, FIG. 20B).

Three moves are important in an efficient release, for example, as has been successfully demonstrated by the golf legend Tiger Woods. Supination is where the left wrist turns to face the palm up. Wrist bowing or flexion is where the wrist moves in a forward motion, and Ulnar Deviation (UD) is where the thumb starts to point down.

Wrists, load (cocks), swing forward, unload properly (un-cocked): Training regimens using the golf training device described hereinabove, can include wrists load, swing forward, unload properly, left wrist uncocks, bowing appearance, supinating (rotating) and on completion the ball ends up inside the forearm (right or left depending on right or left handed swings).

Audio cue: Sliding mass 601, acts as timing mechanism by the audio cue of the weight sliding through tube 107 and reaching end stop 201 to teach proper cocking and uncocking by a time delay corresponding to the distance of travel of the sliding weight and sliding characteristics such as caused by friction of sliding mass 601 against the inside wall of tube 107. The proper audio cue timing corresponds to the Max lag position: Max lag and snap in direct contrast with an incorrect and less efficient "casting" motion. The snap motion corresponds to the sliding mass travel (a brief sliding sound) ending with the sliding mass slamming against end stop 201 (a snap sound).

Figure 16:
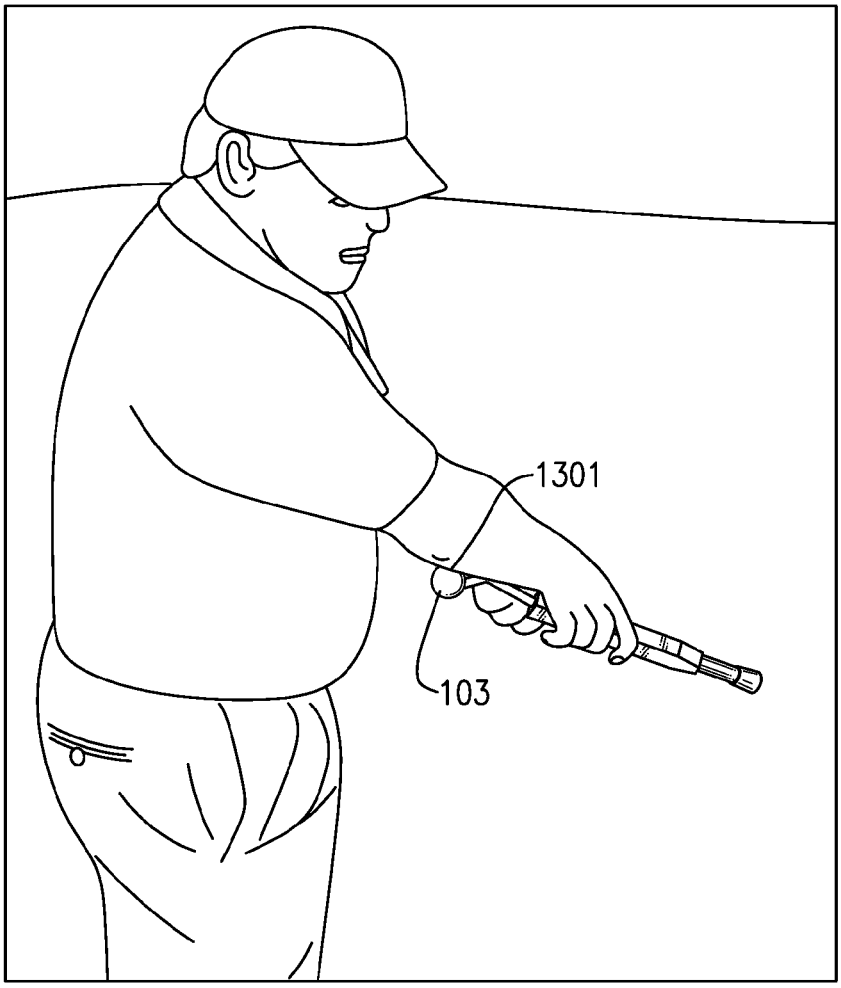
FIG. 16 is a drawing which illustrates a correct end swing position of the ball.
Figure 17A:
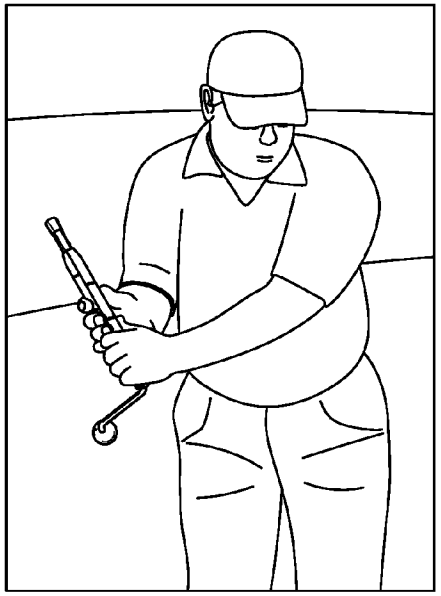
FIG. 17A is a drawing which illustrates a first position for snap training.
Figure 17B:
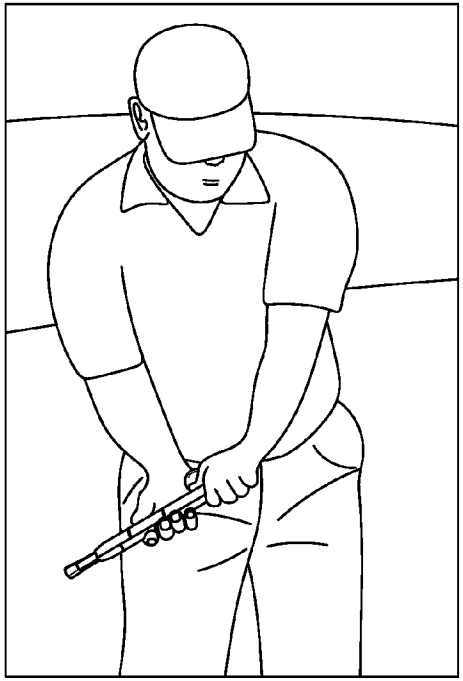
FIG. 17B is a drawing which illustrates a snap motion.
Figure 17C:
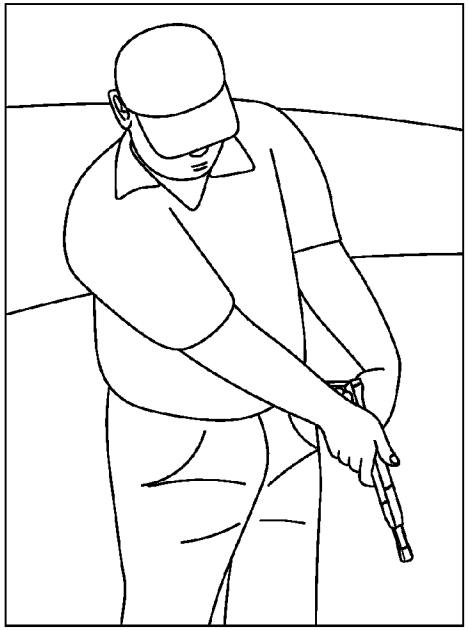
FIG. 17C is a drawing which illustrates an end position for snap training.

Visual/Touch cue: Also, ball 103 serves as a check point ball to show and indicate by touch a correct position (e.g. FIG. 16, FIG. 17C, FIG. 20B). At the completion of a well-executed swing according to the training described herein, as illustrated by FIG. 16, ball 103 should end up inside of right arm form or trailing form (resting on or near the underside of the forearm). When otherwise positioned (e.g. away from, or not touching the forearm), the device indicates a less desirable swing, such as an improper flipping of the golf club. The device teaches timing and position of the motion of the Golfer's wrist for a proper and efficient release. In an exaggeration drill stretching out and emphasizing the component moves of the desired golf swing, the student gets the ball to more towards the front of the forearm as opposed to ending up directly underneath the arm.

Incorrect techniques: The sound of the weight bottoming out against end stop 201 too early (instead of a later delayed sound) is indicative of an improper "casting" in contrast with the desired snap motion. Following an improper swing, ball 103 ends in an incorrect position not touching or not very close to the forearm. At the completion of each well executed training swing, ball 103 should be just inside, and preferably touching the inside of the forearm.

Figure 18A:
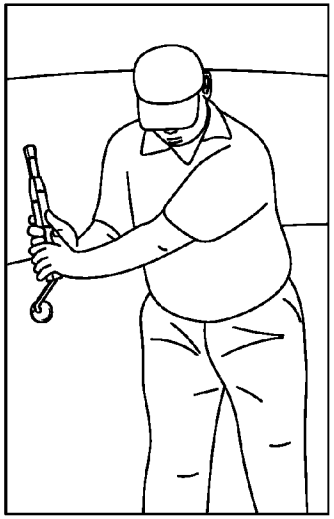
FIG. 18A is a drawing which illustrates a first position for cock-snap training.
Figure 18B:
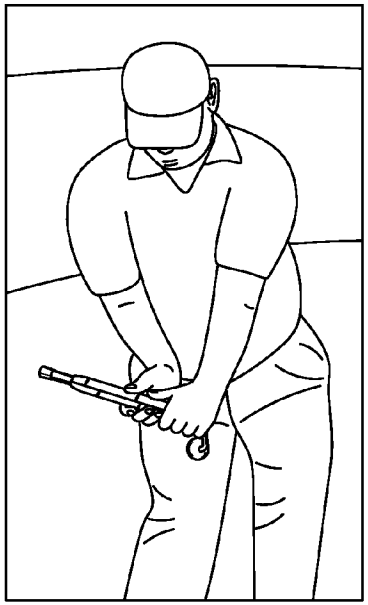
FIG. 18B is a drawing which illustrates a cocked position before a snap motion.
Figure 18C:
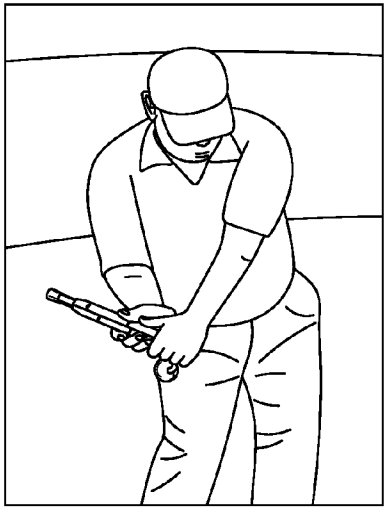
FIG. 18C is a drawing which illustrates a snap motion.
Figure 18D:
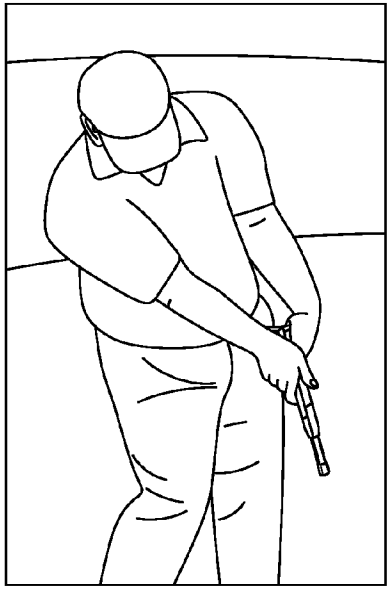
FIG. 18D is a drawing which illustrates an end position for cock-snap training.
Figure 19:
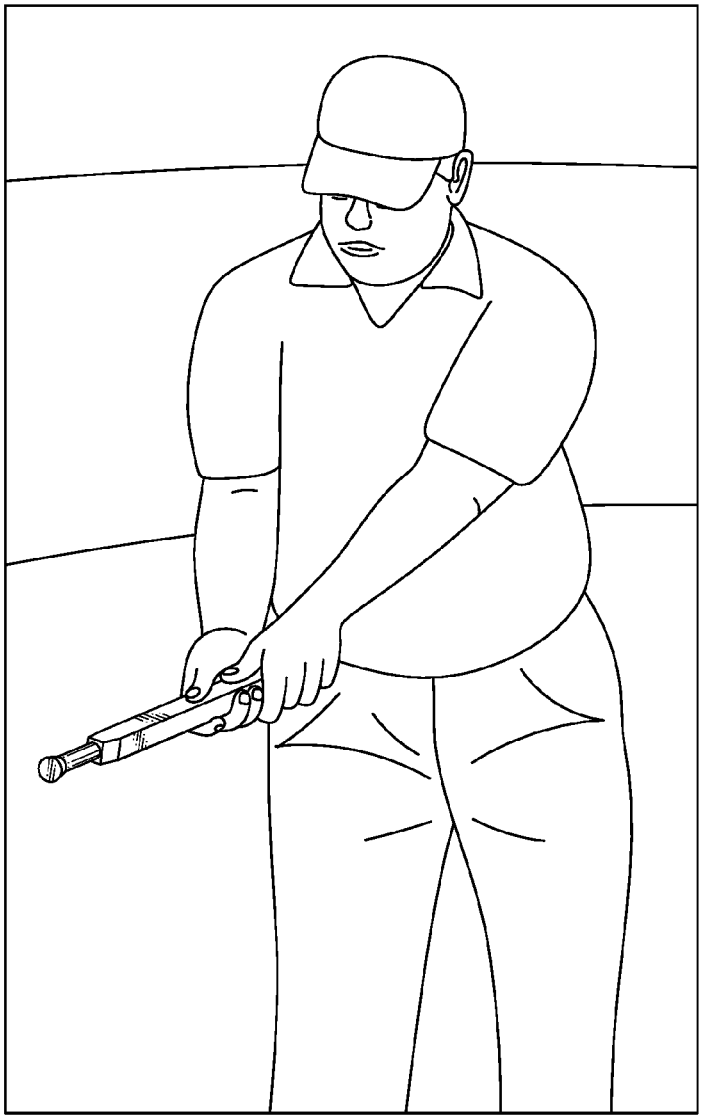
FIG. 19 is a drawing which illustrates an incorrect casting motion.

FIG. 19 illustrates a common golf swing error, swinging using a casting motion. To an attentive golf student, the audio cue of the sliding mass 601 calls out the error of an improper swing, such as the undesirable casting swing. By contrast, a properly trained swing has a delayed snap sound. For example, FIG. 18A illustrates a proper starting position. There is a deliberate, however relatively slower motion to cock the arms and wrist from FIG. 18A to the cocked position of FIG. 18B. From the cocked position of FIG. 18B, is there a snapping motion of FIG. 18C from FIG. 18B. The snapping motion which only commences at FIG. 18C causes the sliding mass 601 to travel down tube 107 towards the end stop 201, at which point there is a snap sound at the end of the sliding sound, the audio cue of a properly executed swing according to the technique taught by a golf training device 100.

The golf training device 100, as described hereinabove provides a relatively fast way to learn the techniques of a good golf club swing. To our best understanding, the golf training device 100, especially with its audio and visual cues, provides a quicker and more direct neurological-brain learning process. The golf training device 100 is particularly suited for training the wrist during indoor winter training.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A golf training device with audio and visual/touch cues for independent golf swing training in an absence of a golf instructor comprising:

a tube having a first end and a second end and an outer surface;

a hand grip disposed at least in part about said outer surface of said tube;

a sliding mass disposed slidingly within said tube, said sliding mass comprising a chamfer on at least one end of said sliding mass;

an end stop mechanically affixed to said first end of said tube;

a ball holding rod having a ball hold rod first end and a ball hold rod second end;

a bushing disposed on said ball hold rod first end to mechanically couple said ball hold rod first end to said second end of said tube, an outer diameter of said bushing comprising a male thread corresponding to a female thread disposed in said second end of said tube;

a ball mechanically coupled to said second end of said ball holding rod; and wherein said ball holding rod comprises a first ball holding rod bend of about 80 degrees near where said ball holding rod couples to said tube and a second ball holding rod bend of about 70 degrees near said ball, and about an 80 to 90 degree angle between two planes defined by each of said first ball holding rod bend and said second ball holding rod bend.

2. The golf training device of claim 1, wherein said tube comprises aluminum.

3. The golf training device of claim 1, wherein said ball holding rod comprises aluminum.

4. The golf training device of claim 1, wherein said end stop comprises one half of a threaded pipe coupler.

5. The golf training device of claim 1, wherein said bushing comprises a modified pipe thread.

6. The golf training device of claim 1, wherein said sliding mass comprises a cold rolled steel rod.

7. The golf training device of claim 1, wherein said sliding mass comprises a mass between about 100 and 300 grams.

8. The golf training device of claim 1, wherein said ball comprises a golf ball.

9. The golf training device of claim 1, further comprising a cap disposed over said end stop and a portion of said first end of said tube.

10. The golf training device of claim 9, wherein said cap comprises an air hole.

* * * * *